United States Patent [19]

Ogura et al.

[11] Patent Number: 4,924,823

[45] Date of Patent: May 15, 1990

[54] SIX STROKE INTERNAL COMBUSTION ENGINE

[75] Inventors: Yukihiro Ogura, Suzuka; Yasuo Ikenoya, Saitama, both of Japan

[73] Assignee: Honda Giken Kogyo Kabushiki Kaisha, Tokyo, Japan

[21] Appl. No.: 254,818

[22] Filed: Oct. 7, 1988

[30] Foreign Application Priority Data

Oct. 7, 1987 [JP] Japan ..... 62-254500

[51] Int. Cl.[5] ..... F02B 75/02

[52] U.S. Cl. ..... 123/64; 123/310; 261/44.3

[58] Field of Search ..... 123/64, 90.1, 310, 439; 261/44.3

[56] References Cited

U.S. PATENT DOCUMENTS

| | | | |
|---|---|---|---|
| 1,068,173 | 7/1913 | Schimanek | 123/64 |
| 1,091,703 | 3/1914 | Pratt | 123/64 |
| 1,339,176 | 5/1920 | Dyer | 123/64 |
| 1,793,148 | 2/1931 | Warlay | 261/44.3 |
| 1,882,971 | 10/1932 | Schimanek | 123/64 |
| 1,969,815 | 8/1934 | Meyer | 123/64 |
| 2,209,706 | 7/1940 | Rudd | 123/64 |
| 2,941,522 | 6/1960 | Sagona | 123/64 |
| 3,382,853 | 5/1968 | Kinoshita | 261/44.3 |
| 4,150,070 | 4/1979 | Hashimoto et al. | 261/44.3 |
| 4,508,073 | 4/1985 | Hofbauer et al. | 123/310 |
| 4,563,990 | 1/1986 | Kishida et al. | 123/439 |
| 4,579,097 | 4/1986 | Yamamoto et al. | 123/439 |
| 4,777,915 | 10/1988 | Bonvallet | 123/90.11 |

*Primary Examiner*—David A. Okonsky

[57] ABSTRACT

An internal combustion engine generally utilizes a conventional four stroke process including an intake stroke, compression stroke, expansion stroke, and exhaust stroke and in addition to this four stroke process, adds a secondary process having two additional strokes for scavenging the combustion chamber with fresh air. This two stroke scavenging process employs a fresh air intake stroke and a fresh air exhaust stroke to exhaust any remaining burnt and unburnt gases from the combustion chamber.

11 Claims, 7 Drawing Sheets

SIX STROKE INTERNAL COMBUSTION ENGINE

FIELD OF THE INVENTION

The present invention relates to a fuel efficient internal combustion engine system employing scavenging strokes to scavenge gases out of the cylinder after combustion. More particularly, the present invention is directed to an internal combustion engine which utilizes the intake, compression, power and exhaust strokes of a conventional four stroke internal combustion engine (the first process) and additionally utilizes an intake air only stroke and air exhaust stroke (collectively, the second process) which function to scavenge the combustion chamber after the first process.

BACKGROUND OF THE INVENTION

It has long been desirable to increase the efficiency of internal combustion engines, particularly engines utilized in automobiles and the like. In order to increase the efficiency of such an engine, it is desirable to reduce mechanical loss within the engine and to improve the efficiency of combustion of the fuel itself.

The conventional four stroke internal combustion engine utilizes an intake stroke, compression stroke, combustion stroke, and exhaust stroke. During the compression stroke, it is important, in order to accomplish complete combustion of the fuel/air mixture provided to the cylinder, to improve the propagation of combustion through the cylinder from the spark plug and to ensure that the air/fuel mixture is as close as possible to the so-called stoichiometric point.

One method to improve fuel combustion is to ensure that the freshly introduced mixture is not contaminated with burnt and unburnt gases incompletely exhausted during the exhaust stroke of a normal internal combustion cycle. Such burnt and unburnt gases deteriorate the propagation of flame throughout the fresh charge mixture and thus, inhibit the efficiency of the engine.

One solution to this problem was proposed in Japanese laid-open application no. 212326/82, published on Dec. 27, 1982 and assigned to the assignee of the present application, which discloses an internal combustion engine utilizing a conventional two-stroke combustion process for a first process and utilizing fresh mixture inducted into the combustion chamber to flush the burnt and unburnt gases from the combustion chamber in a second process.

In this system which uses a two-stroke type internal combustion process for the first process, even if the mixture supply passage and the air supply passage are independent, air for the second process is introduced into the cylinder through a scavenging passage right after being introduced into the crankcase. Since the crankcase has a large volume sized similarly to that of the cylinder displacement, the fresh air is mixed with the remaining mixture of the prior stroke during the scavenging process, resulting in the use of a mixture of fresh air and remaining air/fuel mixture, and thus, does not provide the sought after degree of improvement in fuel efficiency. Furthermore, as the fresh air is supplied into the cylinder after being compressed in the crankcase, substantial mechanical loss exists.

OBJECTS OF THE INVENTION

It is therefore an object of the invention to improve the fuel consumption of an internal combustion engine by utilizing a four stroke internal combustion first process with a two stroke scavenging process to enhance the fuel efficiency of ah internal combustion engine;

it is a second object to provide a fuel supply device which supplies fuel during the first conventional four stroke internal combustion process and which can supply fresh air during a second scavenging process in order to clean the burnt and unburnt gases from the combustion chamber to prevent their deterioration of the propagation of combustion within the combustion chamber when ignition of the freshly introduced air/fuel mixture is achieved;

it is a still further object of the present invention to provide a fuel supply apparatus for an internal combustion engine which is designed to supply air flow to the combustion chamber during the intake stroke at a rate substantially proportional to the supply of fuel to the internal combustion engine during the intake stroke to thereby allow the introduction of a constant air/fuel ratio in the internal combustion engine, preventing the mixture from being overly lean during some throttle openings or overly rich during other throttle openings;

it is still further object of the present invention to perform the above mentioned scavenging process every third crankshaft revolution, increasing the total number of revolutions per complete cycle of the engine to three.

SUMMARY OF THE INVENTION

These and other objects may be accomplished by the novel fuel supply method and apparatus for an internal combustion engine produced according to the present invention. This internal combustion process includes a first process which comprises the four strokes of a normal four stroke internal combustion engine including an intake stroke, compression stroke, expansion stroke and exhaust stroke; whereby output power can be generated, and a second scavenging process having two strokes, which is performed after the four strokes of the normal four stroke internal combustion engine process and which is formed of an intake stroke which introduces only air into the combustion chamber and an exhaust stroke, whereby the remaining burnt gas in the combustion chamber can be scavenged to prevent the inhibition of the propagation of flame through the introduced charge mixture due to residual gases during the subsequent compression stroke.

The above mentioned process is performed by a system whereby the cam shaft of the internal combustion engine is provided with an additional lobe on each cam and is rotated at a rate of one-third that of the crankshaft so that one complete cycle of the first process and second process is performed every three revolutions of the crankshaft. Accordingly, the intake stroke of the first process and intake air stroke of the second scavenging process is accomplished by separate lobes of the intake cam and the exhaust stroke of the first process and the exhaust air stroke of the scavenging process are performed by separate lobes of the exhaust cam. The device of the present invention receives its intake charge through a carburetor which includes a primary tract through which air/fuel mixture is supplied during the intake stroke, and a secondary tract through which fresh air is supplied during the air intake stroke of the second process.

Operation of this second intake tract is performed by a solenoid valve responsive to the rotation of the cam shaft which controls the operation of the secondary tract to supply fresh air to the combustion chamber and through the use of an air flow controlling piston which controls the amount of air flow through the secondary fresh air flow passage in response to the temperature of the engine monitored by a temperature sensing washer installed under the spark plug. Accordingly, as the temperature of the engine increases, the amount of air flow through the engine is increased to cool the combustion chamber through enhanced inside air flow. Accordingly, the control of the fresh air provided during the scavenging step may be automatically adjusted to maximize engine performance while minimizing consumption of fuel.

BRIEF DESCRIPTION OF THE DRAWINGS

The above mentioned objects and features of the present application may be understood from the drawing figures as described below and the detailed description of the preferred embodiments described below. The present invention is illustrated in the drawings wherein.

DETAILED DESCRIPTION OF THE PREFERRED EMBODIMENTS

Figure 1:
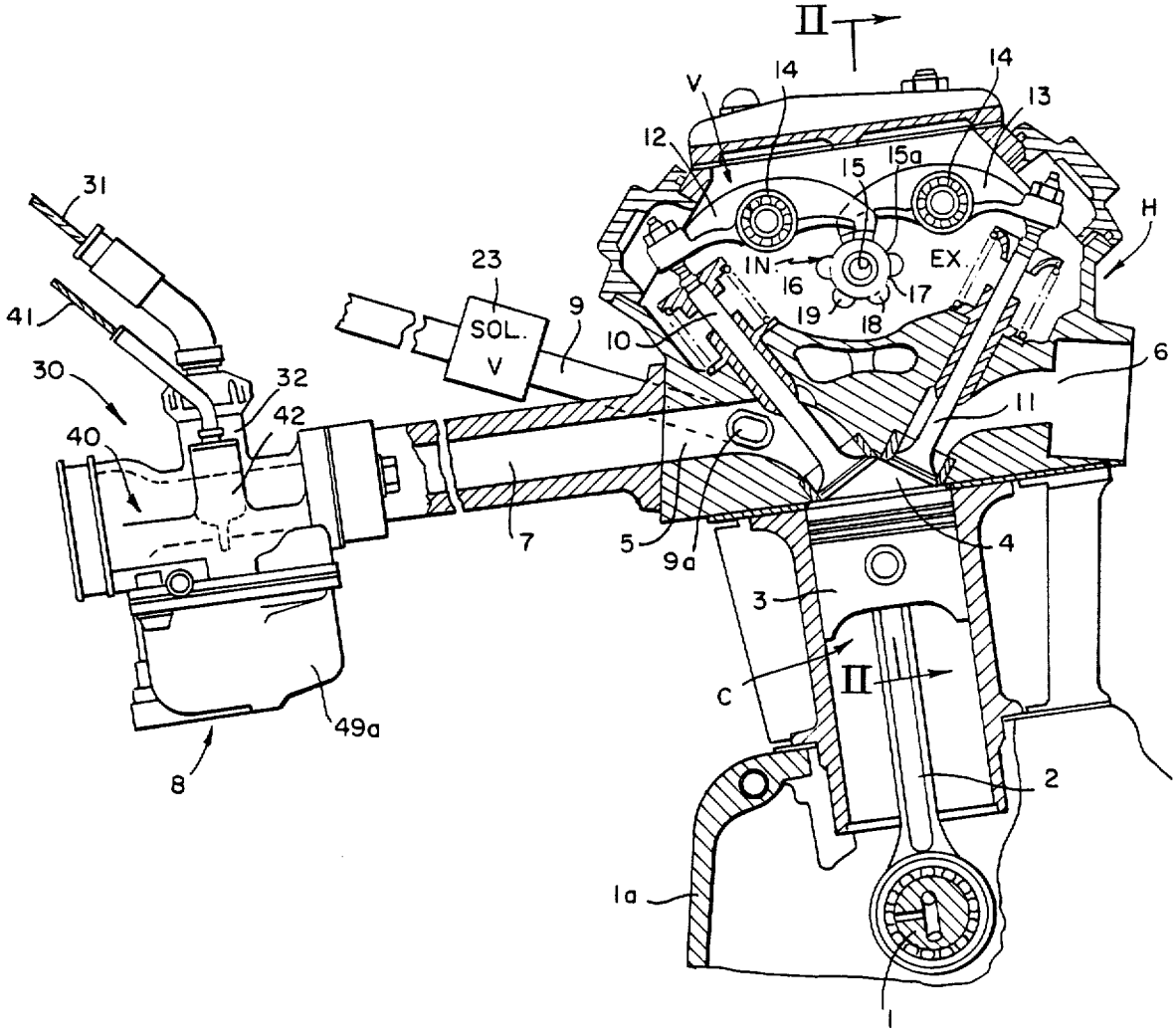
FIG. 1 is a vertical sectional view of an embodiment of the present invention illustrating the fuel supply system and camshaft drive system of the present invention.
Figure 2:
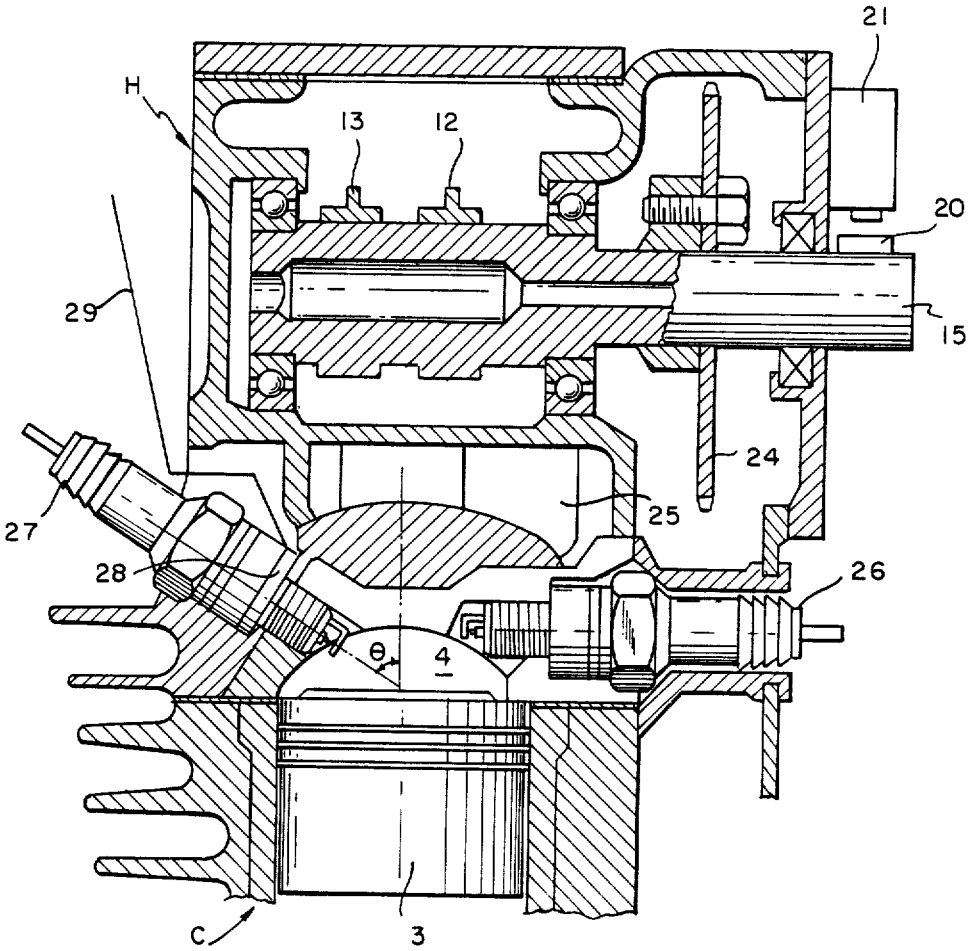
FIG. 2 is a sectional view along lines II—II of FIG. 1 and illustrating in particular the configuration of the camshaft and spark plugs according to the teachings of the present invention.

FIG. 1 and FIG. 2 show one preferred embodiment according to the present invention. FIG. 1 is a vertical sectional view of the internal combustion engine showing an intake valve and an exhaust valve. FIG. 2 is an enlarged vertical sectional view along with line II—II of FIG. 1.

A crankshaft 1 mounted within a crankcase la is connected to a piston 3 in the cylinder C through a connecting rod 2 made in the preferred embodiment, of a light material such as a titanium compound metal. Surface coating treatment of fluoric plastic material is employed on the piston in order to reduce the friction loss thereof.

Both an intake passage 5 and an exhaust passage 6 communicate with a combustion chamber 4 in a cylinder head H mounted above the piston 3. The intake passage 5 communicates with a mixture passage 7 through a carburetor 8 and through an air passage 9 independent from the mixture passage 7. A valve operating mechanism V is housed in the cylinder head H. The valve operating mechanism V drives both an intake valve 10 and an exhaust valve 11 to open and close the intake passage 5 and the exhaust valve 6. The valve operating mechanism V includes an intake cam IN and an exhaust cam EX which supply valve opening forces to rocker arms 12 and 13, respectively.

The intake valve 10 and the exhaust valve 11 are made of ceramic material. The rocker arms 12 and 13 are interlocking apparatus which drive the intake valve 10 and the exhaust valve 11 under control of the intake cam IN and the exhaust cam EX. Each of the rocker arm shafts is rotatably supported by needle bearings 14, resulting in the reduction of frictional losses. The width of the cam slipper surface, which is the contacting portion with the cam, is narrower than that of prior cam surfaces because of the reduced space between the intake cam IN and the exhaust cam EX.

Figure 3:
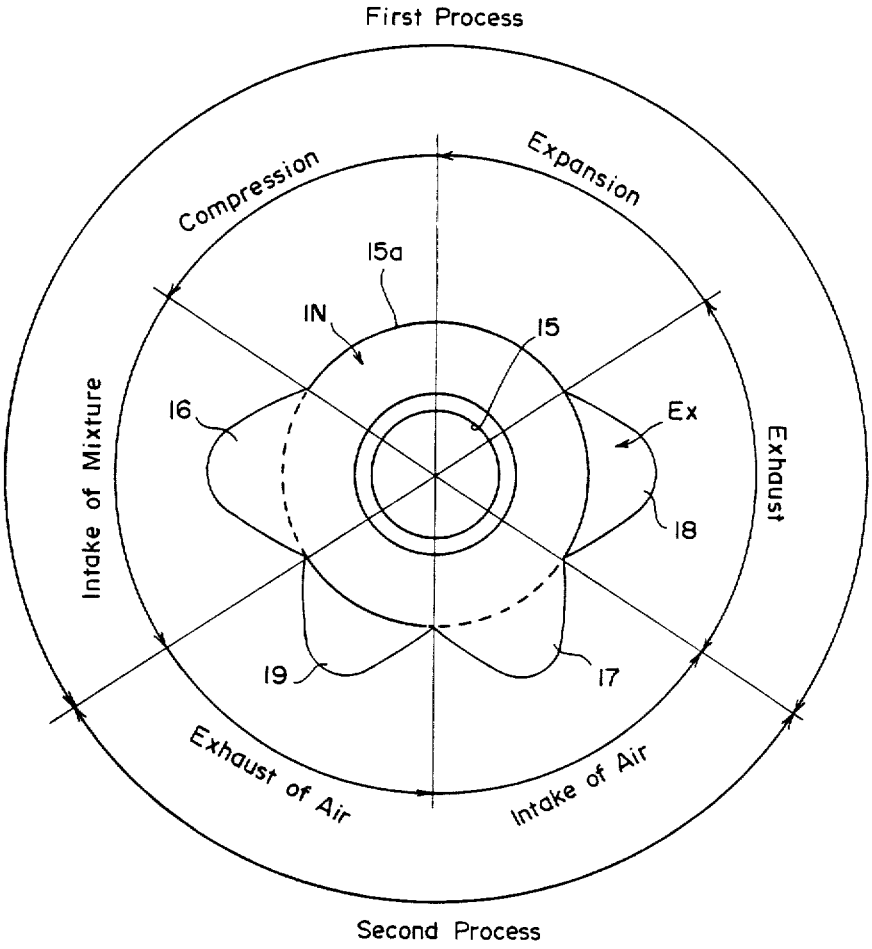
FIG. 3 is a cam angle diagram showing the relationship between the cam and each stroke of the first and second processes according to the teachings of the present invention.

The intake cam IN and the exhaust cam EX are formed around the cam shaft 15 as shown in enlarged FIG. 3. The intake cam IN is formed of a primary intake cam 16 and a secondary intake cam 17. The exhaust cam EX is also formed of a primary exhaust cam 18 and a secondary exhaust cam 19. These cams IN,EX collectively manage four strokes of the first process relating to the generation of output power (the traditional four stroke process) and two strokes of the second process relating to the scavenging of the cylinder. Each stroke made by each cam is shown in FIG. 3.

A projection 20 is made at one end of the cam shaft 15 and a well-known pulse generator 21 is disposed close to the rotating locus of the projection 20. The pulse generator 21 detects the rotating angle of the cam shaft 15.

Figure 4:
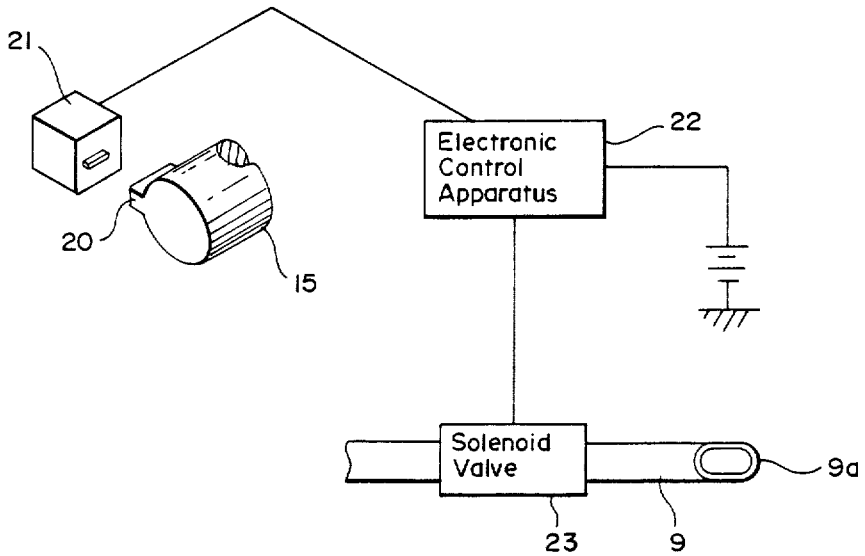
FIG. 4 is a schematic diagram of a control system of the present invention in which an electronic control apparatus controls the operation of a solenoid valve 23 in response to the position of a projection 20 on the camshaft 15 sensed by a pulse generator.

As shown in FIG. 4 the detecting signal controls the opening and closing of a solenoid valve 23 provided in the middle of the air passage 9 through any suitable known electronic control apparatus 22.

Number 24 in FIG. 2 is a sprocket which can transmit the rotation of the crankshaft 1 to the cam shaft 15 at reduction ratio of ⅓ (one-third). Number 25 is a water jacket to improve the cooling of the cylinder head H. Numbers 26 and 27 are a pair of spark plugs facing the combustion chamber 4.

The first spark plug 26 is fitted at a right angle to the central axis of the cylinder C and the second spark plug 27 is fitted at a predetermined inclining angle 0 thereto.

Both the spark plugs 26,27 are positioned in substantially the same vertical plane which includes the central axis of the cylinder C. A slight difference is provided between both spark timings. In the present embodiment the spark plug 26 is adjusted to fire 1/600 of a second after the spark plug 27 has been fired. A swirl flame is therefore created by the collision of both the flame propagations from the two spark plugs, shortening the time of the flame propagation. Element 28 is a temperature sensing washer for the spark plug 27. Element 29 symbolically indicates the wire upon which the signal from the temperature sensing washer 28 is supplied.

The carburetor 8 will now be described with reference to FIG. 1. The carburetor 8 has a primary throttle portion 30 and a secondary throttle 40. Numerals 31 and 41 show a primary throttle wire and a secondary throttle wire, respectively, and numerals 32 and 42 are a primary throttle body and a second throttle body, respectively.

Figure 5:
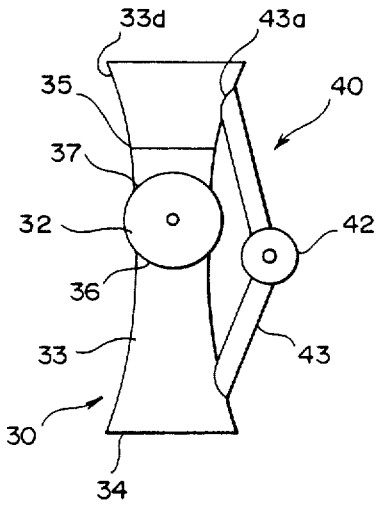
FIG. 5 is a schematic plan view of the inlet tracts provided within the carburetor 8 of FIG. 1.

FIG. 5 shows a schematic plan view of the carburetor 8. The secondary throttle portion 40 is located beside the primary throttle portion 30 and has a side passage 43 bypassing the primary throttle body 32.

The cross-sectional form of the throttling passage 33 of the primary throttle portion 30 continuously varies along the intake tract. An inlet 34 of the upstream portion of the throttling passage 33 and an intermediate portion 35 of a downstream portion 33*d* which is upstream of an end portion 43*a* of a side passage 43 both have a circular cross-section (CS). Throttle passage portions 36,37 connecting to the throttle body 32 have reverse triangle forms (DB (delta-bore mentioned hereinafter) as shown in a solid line in FIG. 6. The throttling passage between the circular cross-section and the reverse triangle form (DB) changes smoothly to make a substantial oval form (SO of FIG. 6) at points intermediate therebetween.

Figure 6:
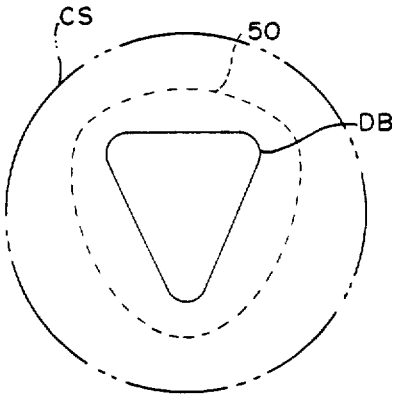
FIG. 6 is a schematic representation of the cross-sections which exist in various portions of the inlet tract of the carburetor as illustrated in FIG. 5.

FIG. 6 shows the overlapping condition of each portion. The two dotted lines show the circular section CS and the dotted line SO shows the sectional middle portion of the substantial oval.

Figure 7:
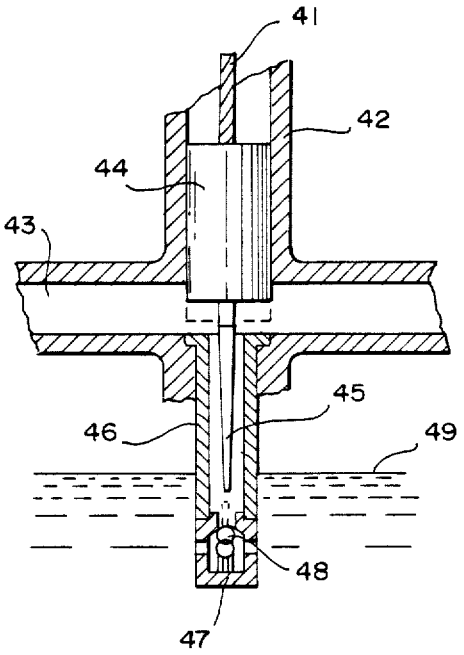
FIG. 7 is a sectional view of a portion of the secondary throttle passage shown in FIGS. 1 and 5.

The secondary throttle passage 40 as shown in FIG. 7 is provided with a piston 44 in the secondary throttle body 42 actuated by a secondary throttle wire 41 and a needle valve 45 vertically in the bottom thereof. A starter jet 47 is provided in the bottom portion of a nozzle 46 through which the needle valve 45 moves up and down. A check valve 48 is provided in the starter jet 47.

When the piston moves downwardly, the needle valve 45 pushes down on the check valve 48 to thereby open it allowing flow through to the starter jet 47. When the piston moves upwardly, the pressure of the needle valve 45 on the check valve 48 is removed to close the check valve 48 and thus the starter jet 47. Element 49 is the fuel level in the carburetor float bowl (element 49*a* of FIG. 1).

Figure 8:
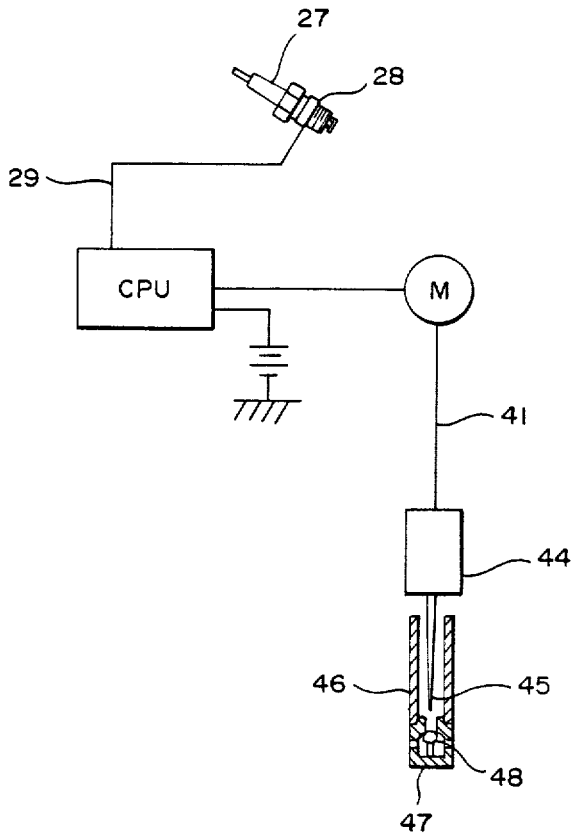
FIG. 8 illustrates schematically the servo control for the piston in the secondary throttle passage under control of the temperature monitored by the spark plug washer 28.

As shown in FIG. 8 the operation of the piston 44 is controlled according to the function of the temperature of the spark plug 27. The temperature signal developed on signal wire 29 by the temperature sensor assembled in the spark plug washer 28 is connected to the CPU. When the temperature becomes more than the predetermined temperature, for example above 60° C. (sixty degrees Centigrade), a servo-motor is actuated to move the piston 44 upwardly by the secondary throttle wire 41 and the side by-pass passage 43 is thereby opened to increase the air flow therethrough. In case of the starting or warm-up running of the internal combustion engine where the spark plug washer 28 develops a low temperature signal, the piston 44 is closed to make the by-pass passage 43 smaller and the starter jet 47 supplies fuel to the cylinder to make a richer mixture than the normal one, thereby performing the same function of the choke valve.

When the temperature sensed by the spark plug washer 28 becomes over 60° C., fresh air is supplied to the intake passage 5 through the by-pass passage 43. The end portion 43*a* of the by-pass passage 43 opens tangentially to the cross-section of the primary throttle portion 33*d* so that air coming from the end 43*a* can be supplied in the intake track by swirling the air spirally along the intake surface of the throttle portion. This swirl of intake air can brush liquid fuel off the interior surface of the inlet tract resulting in an improvement in fuel economy. Therefore, it can make the air fuel ratio around the primary throttle portion 30 lean. The sectional area of the air passage 9 is formed larger than the restricting portion DB of the carburetor 8 when at maximum opening. The opening portion 9*a* of the intake passage 5 opens to the portion of the intake valve 10 and is formed at the same level or even slightly projected from the interior surface of the intake passage 5 to reduce the flow resistance.

The fuel supply method according to the present embodiment will be described in the following. The present fuel supply method consists of a first process relating to air fuel mixture (a conventional four stroke process) and a second process relating to fresh air scavenging.

FIG. 1 shows the top dead center position of the compression stroke which corresponds to the vertical position of the cam chart of FIG. 3. The cam shaft 15 rotates counterclockwise. At first, the first process will be described in detail.

Intake Stroke

The intake cam 16 push up the rocker arm 12 to open the intake valve 10 and the mixture is conducted into the combustion chamber 4 through the carburetor 8, the mixture passage 7 and the intake passage 5.

Compression Stroke

The rocker arms 12 and 13 now follow the base circles 15*a* of the intake cam IN and the exhaust cam EX to close the intake valve 10 and the exhaust valve 11 and the mixture is compressed by the up-stroke of the piston 3.

Expansion Stroke

The rocker arms 12 and 13 are still following the base circles 15*a* of each of the intake cam IN and the exhaust cam EX and the compression mixture is sparked by each of the spark plugs 26 and 27 shown in FIG. 2, thus obtaining good flame expansion.

Exhaust Stroke

The rocker arm 13 follows the primary exhaust cam 18 to lift up the exhaust valve and the exhaust gas is emitted from the combustion chamber. The above description is generally similar to the output generation of a conventional four-stroke internal combustion engine which corresponds to the first process developed by two crankshaft revolutions and two complete back and forth strokes of the piston. The present invention next conducts the second process which is completed by one revolution of the crankshaft and a single back and forth stroke of the piston.

Intake Stroke (Second Process)

The rocker arm 12 follows the secondary intake cam 17 to open up the intake valve 10. In a very small quantity of time before the intake valve 10 is lifted, the air passage 9 is opened by activation of the solenoid 23 to open the air passage. The control device 22 controls the solenoid 23 according to the signal of the pulse generator 21. The piston 3 moves from top dead center to bottom dead center and only fresh air is conducted into the combustion chamber 4 from the air passage 9 with comparative low flow resistance.

Exhaust Stroke (Second Process)

The rocker arm 13 follows the secondary exhaust cam 19 to open up the exhaust valve 11. The piston 3 moves from the bottom dead center to the top dead center and the conducted fresh air in the cylinder pushes out the remaining burnt gas and cools the interior surface of the cylinder. In the past the maximum accepted limit of the compression ratio was approximately 10:1. However, the present embodiment can obtain the higher maximum compression ratio about 15:1 ~ 16:1 by the present scavenging process of the good remaining burnt gas exhaust and the improvement of the cooling efficiency, resulting in the improvement of the combustion pressure.

As mentioned above, both the first and second processes collectively including six strokes constitutes the novel engine system of the present invention.

Figure 9:
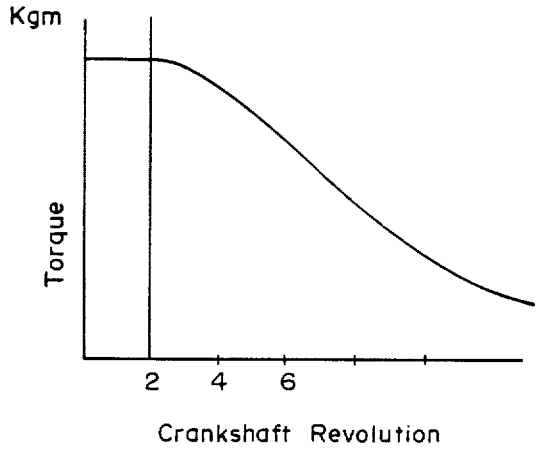
FIG. 9 is a graph showing the variation in torque as varied by the number of rotations of the crankshaft per power stroke in a four cycle type internal combustion engine.

As can be seen from FIG. 9 of the present application, in an internal combustion engine constructed of conventional materials and running at 3000 rpm, when the ignition is switched off, the torque generated by the engine starts to change only after the crankshaft makes two revolutions. The flywheel effect causes this delay in torque reduction and allows the engine to retain substantially the same torque for two revolutions after the ignition is switched off. Therefore, in the present embodiment, when a single additional engine revolution is added between ignition firings to add two further strokes in addition to the prior four strokes used in a conventional four stroke engine, the output torque is not significantly reduced.

Figure 10:
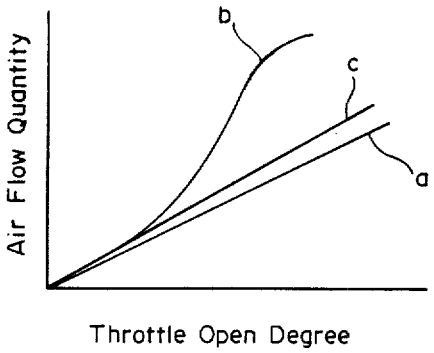
FIG. 10 is a graph showing the air/fuel flow variation as it relates to the degree of throttle opening.

Further according to the teachings of the present application, fuel consumption is substantially enhanced by using a carburetor 8 which utilizes a delta bore DB as illustrated, for example, in FIG. 6. As shown in FIG. 10, the conventional circular venturi carburetor has a linear relationship (shown in line a) between the quantity of air flowing through the venturi and the degree of throttle opening. However, in such a carburetor the corresponding fuel characteristics are non-linear as shown in line b and thus the air/fuel ratio varies with throttle opening. Therefore, if the air/fuel ratio of the carburetor is not adjusted to be lean in the low throttle openings of the carburetor, the ratio becomes too rich and when the throttle is fully opened. On the other hand, if the air/fuel ratio is adjusted to be lean when the throttle is wide open, the air/fuel ratio will become much too lean during low rpm operating conditions.

According to the teachings of the present invention, a delta bore DB is utilized to control the air flow in a fashion which is approximately linear to the fuel flow developed from the carburetor. Accordingly, the fuel flow is developed approximately in proportion to the air flow as illustrated in line c to retain a constant air/fuel ratio. Since the air/fuel ratio is more nearly constant for a variety of throttle openings, a lower air/fuel ratio may be utilized according to this configuration than in the prior art where the air/fuel ratio must be set so that it is operable at all speeds and throttle openings despite a wide variation in the air/fuel ratio with throttle opening.

As described above, the present invention employs the conventional four strokes used in a four stroke internal combustion engine and adds two additional strokes to provide fresh air scavenging, thereby forming a six stroke internal combustion device which results in an enhanced fuel efficiency. According to the teachings of the present application, improvement in flame expansion, the lean of the air/fuel ratio, and the use of low friction construction further improve fuel consumption.

According to the teachings of the present invention, the fuel supply method of the present invention allows a higher compression ratio as the fresh air is used to scavenge the combustion chamber so that only fresh charge is present during the combustion process.

The above discussed embodiment of the present invention is exemplary only and is useful in understanding the concepts and features of the present invention, the scope of the present application and the invention described therein being defined solely by the appended claims.

We claim:

1. A method of producing power from a fuel/air mixture in an internal combustion engine comprising:

conducting a four stroke internal combustion process, by, intaking fuel/air mixture into a combustion chamber, compressing said fuel/air mixture, causing combustion of said fuel/air mixture, said step of combusting leaving burned and unburned gases in said combustion chamber, exhausting said burned and unburned gases, said step of exhausting incompletely exhausting said burned and unburned gases from said combustion chamber; and conducting a two stroke combustion chamber scavenging process by, introducing fresh air into said combustion chamber during a fresh air intake stroke by, monitoring the temperature of the combustion chamber, and controlling the amount of air introduced during said step of introducing fresh air by increasing said amount with increasing temperatures, and exhausting said introduced fresh air with the remaining said burned and unburned gases to scavenge said combustion chamber.

2. The method of claim 1 wherein said step of introducing fresh air includes controlling the passage of air through a secondary air passage, said step of controlling allowing air through said passage only during said step of introducing fresh air.

3. An internal combustion power generation system comprising:

a combustion chamber, defined by a chamber head and cylinder;

a piston mounted in said cylinder for reciprocation about a crankshaft;

at least one intake valve, supplying air/fuel mixture to said chamber;

at least one exhaust valve for exhausting exhaust gases from said chamber;

an intake cam and an exhaust cam for respectively controlling said intake and exhaust valves;

said crankshaft rotating three times for each rotation of said intake cam and exhaust cam;

said system developing a conventional four cycle internal combustion process during two of said three crankshaft rotations while developing a fresh air intake stroke and fresh air exhaust stroke in the third revolution to form a two cycle scavenging process;

fuel mixture supply means for supplying the air/fuel mixture to said intake valve during an intake stroke of the conventional four stroke internal air stroke;

air intake supply means for supplying fresh air intake to said intake valve during said intake air stroke;

a combustion chamber temperature sensor detecting combustion chamber temperature; and fresh airflow control means, responsive to said combustion chamber sensor, for controlling the supply of fresh air intake provided through said intake supply means to said combustion chamber during said intake air stroke in response to change of combustion chamber temperature.

4. The system of claim 3 wherein said intake cam and said exhaust cam each have first and second cam lobes, said first lobe of said intake and exhaust cam operating on its respective valve during said conventional four cycle process while said second lobe operates on that valve during said two cycle scavenging process.

5. The system of claim 3 wherein said air intake supply means includes, an intake air passage, a sensor monitoring the rotation of said intake cam, and solenoid valve means, mounted in said intake air passage and responsive to said sensor, for opening said intake air passage only during said intake air stroke.

6. The system of claim 3 further comprising first and second spark plugs mounted in said chamber head to ignite an air/fuel mixture introduced into said combustion chamber, said first and second spark plugs being positioned in a plane containing the axis of said cylinder and being ignited sequentially to promote a swirl in the flame produced thereby to encourage complete combustion.

7. The system of claim 3 wherein said fresh airflow control means includes, a fresh air throttle valve for controlling airflow through said air intake supply means, and means for varying the opening of the fresh air throttle valve in response to sensed combustion chamber temperature to increase the airflow with higher sensed combustion chamber temperatures.

8. The system of claim 3 wherein said fresh airflow control means increases the fresh air intake supplied through said air intake supply means during said intake air stroke in response to increased combustion chamber temperature.

9. An internal combustion power generation system comprising:

a combustion chamber, defined by a chamber head and cylinder;

a piston mounted in said cylinder for reciprocation about a crankshaft;

at least one intake valve, supplying air/fuel mixture to said chamber;

at least one exhaust valve for exhausting exhaust gases from said chamber;

an intake cam and an exhaust cam for respectively controlling said intake and exhaust valves;

said crankshaft rotating three times for each rotation of said intake cam and exhaust cam;

said system developing a conventional four cycle internal combustion engine process during two of said three crankshaft rotations while developing a fresh air intake stroke and fresh air exhaust stroke in the third revolution to form a two cycle scavenging process; and a carburetor for supplying intake air/fuel mixture to said intake valve, said carburetor having a throat restriction shaped to promote linearity of the air/fuel mixture supplied thereby with respect to throttle opening.

10. The system of claim 9 wherein said carburetor throttle restriction is configured as a reverse triangle.

11. The system of claim 9 wherein said carburetor has a primary air/fuel supply throttle and a secondary throttle, said secondary throttle supplying fresh air during said fresh air intake stroke.

* * * * *